US010681986B1

(12) United States Patent
Sanders et al.

(10) Patent No.: US 10,681,986 B1
(45) Date of Patent: Jun. 16, 2020

(54) SYSTEMS AND METHODS FOR MANICURE HEAD RESTS

(71) Applicant: Jeannie Sanders, Henderson, NV (US)

(72) Inventors: Jeannie Sanders, Henderson, NV (US); Steve Sanders, Henderson, NV (US)

(73) Assignee: Jeannie Sanders, Henderson, NV (US)

( * ) Notice: Subject to any disclaimer, the term of this patent is extended or adjusted under 35 U.S.C. 154(b) by 0 days.

(21) Appl. No.: 16/360,699

(22) Filed: Mar. 21, 2019

(51) Int. Cl.
*A47C 7/38* (2006.01)
*A45D 29/00* (2006.01)

(52) U.S. Cl.
CPC ..... *A47C 7/383* (2013.01); *A45D 29/00* (2013.01)

(58) Field of Classification Search
CPC ..... A47C 7/383; A45D 29/00
USPC ..... 297/410, 391, 397, 399–402
See application file for complete search history.

(56) References Cited

U.S. PATENT DOCUMENTS 5,177,823 A * 1/1993 Riach ..... A47C 7/38 297/408
6,347,773 B1 2/2002 Gross et al.
7,036,168 B1 * 5/2006 Knickerbocker ..... A47G 9/10 5/636
7,610,639 B2 11/2009 Roleder et al.
D683,463 S 5/2013 Huggins
8,931,127 B1 * 1/2015 Moses ..... A47C 27/142 2/65
9,226,587 B2 * 1/2016 Halimi ..... A47C 16/00
9,782,317 B2 * 10/2017 Mount ..... A47C 7/38
2007/0273194 A1 * 11/2007 Fraser ..... A47C 7/383 297/397
2011/0127391 A1 * 6/2011 McDonald ..... A47C 7/38 248/118
2012/0158138 A1 * 6/2012 Brinkerhoff ..... A61G 15/00 623/15.11
2012/0278993 A1 * 11/2012 Gard ..... A47C 20/026 5/640
2014/0312186 A1 10/2014 Mech
2017/0224117 A1 * 8/2017 DuFresne ..... B60N 2/806

* cited by examiner

*Primary Examiner* — Mark R Wendell
(74) *Attorney, Agent, or Firm* — Hunton Andrews Kurth LLP

(57) ABSTRACT

Systems and methods for a manicure head rest are provided. The system may include a head rest mechanically coupled to a plurality of members at one end of the plurality of members that is mechanically coupled to a fastening means at an other end. A first member may be connected to the head rest at one end and second member at the other end. The second member may be connected to the first member at one end and a third member at the other end. The third member may be connected to the second member at one end and a fourth member at the other end. The fourth member may be connected to the third member at one end and the fastening means at the other end. The fourth member may be permanently connected to the fastening means.

33 Claims, 6 Drawing Sheets

SYSTEMS AND METHODS FOR MANICURE HEAD RESTS

FIELD OF THE DISCLOSURE

The present disclosure relates to systems and methods for manicure head rests.

BACKGROUND OF THE DISCLOSURE

Current solutions for manicure head rests are complex and incur several limitations which cause a user to manually hold their head up for an extended period of time without the use of hands to keep them occupied.

These and other drawbacks exist.

SUMMARY OF THE DISCLOSURE

In an exemplary embodiment, the system may include a head rest mechanically coupled to a plurality of members coupled to one another in a series at one end of the plurality of members that is directly mechanically coupled to a fastening means at an other end. A first member may be connected to the head rest at one end and second member at the other end. The second member may be connected to the first member at one end and a third member at the other end. The third member may be connected to the second member at one end and a fourth member at the other end. The fourth member may be connected to the third member at one end and the fastening means at the other end. The fourth member may be permanently connected to the fastening means.

In an example embodiment, a method of manufacturing a manicure system may include providing a head rest. The method may include connecting the head rest to a first member of a plurality of members via a first component. The method may include connecting the first member to a second member via a second component. The method may include connecting the second member to a third component. The method may include connecting the third component to a fourth component.

BRIEF DESCRIPTION OF THE DRAWINGS

Various embodiments of the present disclosure, together with further objects and advantages, may best be understood by reference to the following description taken in conjunction with the accompanying drawings, in the several figures of which like reference numerals identify like elements, and in which.

DETAILED DESCRIPTION

According to the various embodiments of the present disclosure, systems and methods employ a headrest when receiving a manicure.

Figure 1:
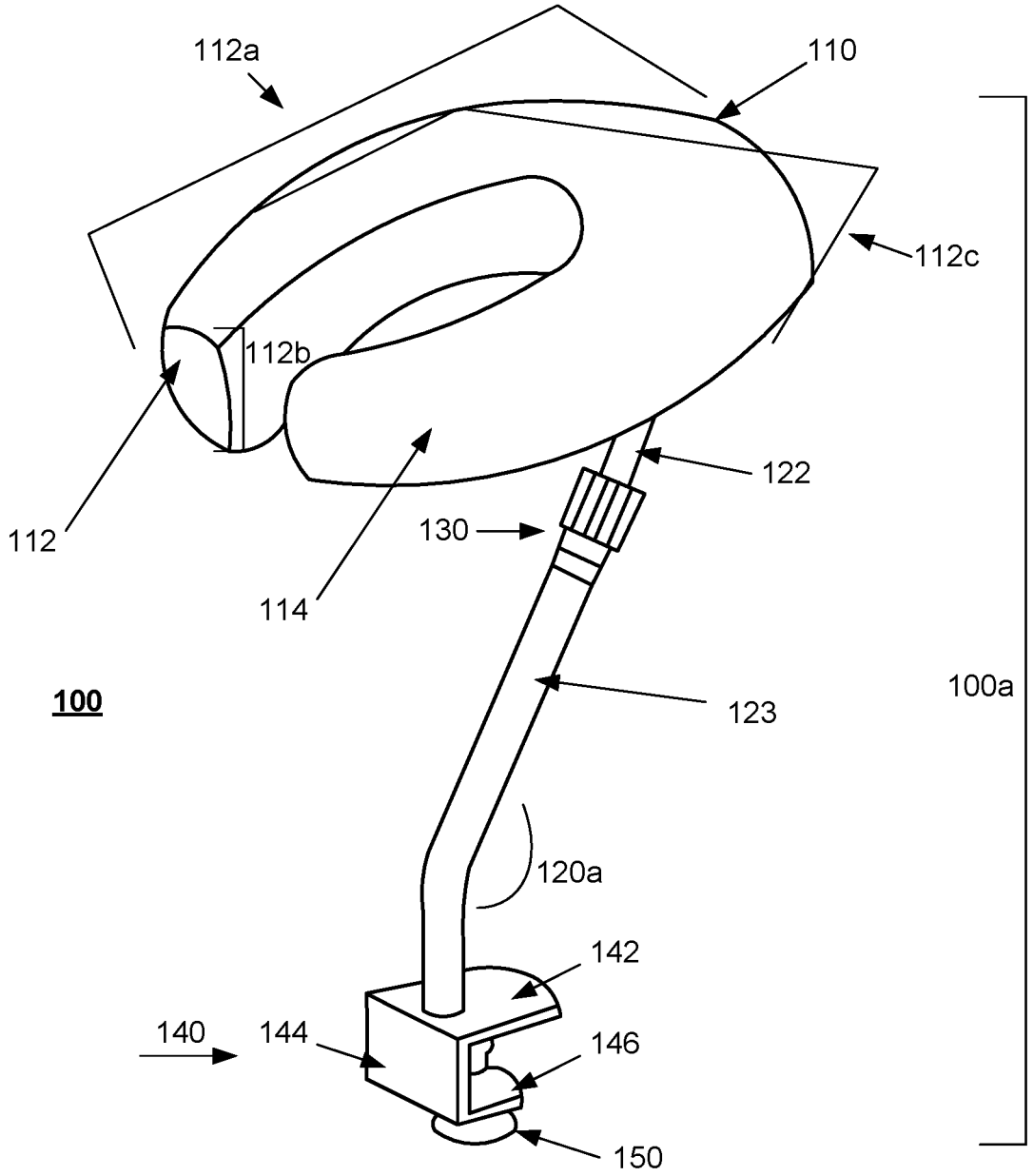
FIG. 1 depicts a schematic of a manicure headrest from a front view perspective according to an example embodiment.

FIG. 1 illustrates a system 100 configured to provide a headrest when receiving a manicure according to an example of the present disclosure. As further discussed below, system 100 may include a headrest 110, a plurality of members 122 and 123, a fastener 130, a base portion 140, and an attachment mechanism 150. Although FIG. 1 illustrates single instances of components of system 100, system 100 may include any number of components. In some examples, system 100 may comprise a facial support system. System 100 may be configured to provide facial support vertically superior to hand positions.

As shown in FIG. 1, system 100 may include a headrest 110. Headrest 110 may comprise a u-shaped or horseshoe-shaped headrest. Other shapes may be used for the headrest. Headrest 110 may comprise a foam cushion, such as a u-shaped or horseshoe-shaped foam cushion. Headrest 110 may comprise a massage table headrest or that of a physical therapy headrest. In some examples, headrest 110 may comprise a memory foam cushion and covered in one or more of natural and synthetic coverings including but not limited to leather, natural and synthetic, or vinyl, natural and synthetic, or any combination thereof. Headrest 110 may be configured to rest at least a portion of the head of a user. In some examples, headrest 110 may be adjusted to rest the portion of the head of the user. Headrest 110 may include a pair of opposing curved portions 112, 114 or arms that originate and project away from a center portion of headrest 110. For example, curved portion 112 (and also 114) of headrest 110 lie substantially in the same plane and may each include a length 112*a* and thickness 112*b*. Headrest 110 may also include width 112*c*. In some examples, headrest 110 may comprise a length 112*a* of eight to ten inches, including 9.5 inches, a width of ten to twelve inches, including eleven inches, and a thickness 112*b* of two to five inches, including three to four inches or two to 2.5 inches, and configured in a u-shape or horseshoe-shape to form headrest 110. In some examples, although headrest 110 may comprise a planar region, it is preferable that one or more portions, such as a central portion, of headrest 110 comprise a depressed or concave region. Headrest 110 may comprise an aperture.

As shown in FIG. 1, system 100 may comprise members 122 and 123. Members 122 and 123 may comprise an elongated cylindrical shaped member. Members 122 and 123 may include material made from plastic, polymer, metal, or any combination thereof. In some examples, members, such as members 122 and 123 may comprise poles, such as aluminum poles. In some examples, members 122 and 123 may be hollow, solid, or any combination thereof. Members 122 and 123 may be dimensioned so as to fit in a series-like configuration. In some examples, members 122 and 123 may comprise a single continuous member. In some examples, members may comprise a first member 122 and a second member 123. As described herein, member 122 and member 123 may be attached to each other by a fastener 130. Member 123 may comprise a diameter exceeding a diameter of member 122. In some examples, second member 123 may comprise a diameter same or similar with respect to a diameter of first member 122. Second member 123 may include an angled or curved portion 120*a*, for example, positioned between about 20° and 40°, including between 15° and 35°. In some examples, member 122 may be configured to connect to a portion of headrest 110. As described below, the portion of headrest 110 may comprise a surface positioned under headrest 110. The surface may be secured to at least an end or portion of member 122 via a plurality of screws (not shown). In some examples, members 122 and 123 may each comprise a length of 3 to 9 inches.

As shown in FIG. 1, system 100 may comprise a fastener 130. Fastener 130 may include an expansion sleeve and a cap configuration. Fastener 130 may be configured to connect to one or more members. For example, fastener 130 may be configured to attach a first member 122 to a second member 123 via an expansion sleeve. One end of each of the first member 122 and second member 123 may be respectively inserted into the expansion sleeve and rotated clockwise or counterclockwise by the cap so as to lock and otherwise tighten or loosen the corresponding grip, respectively. Accordingly, fastener 130 may be configured to adjust a position of headrest 110 by rotation of fastener 130. In this manner, a height 100*a* of system 100 may be modified. Fastener 130 may include material made from plastic, polymer, metal, or any combination thereof.

As shown in FIG. 1, system 100 may include a fastening means or base portion 140. Base portion 140 may be configured to receive one end of member 123. In some examples, base portion 140 may comprise a clamp, such as an industrial strength clamp, or a cup, such as an industrial strength suction cup. An opening of the clamp may be 3-5 inches, including 3-4 inches, to accommodate thickness of an object, such as a table. The thickness of a clamp screw shaft, described below, may be 0.25-0.75 inches thick, including 0.5 inches, and the width of the clamp may be 1-3 inches, including 1.5-2.0 inches. The clamp may comprise material including plastic, metal, or any combination thereof.

In other examples, base portion 140 may comprise a cup, such as an industrial strength suction cup, as further discussed below with reference to FIG. 6.

Base portion 140 may comprise a jaw configuration and be configured to project away or in a direction opposite to a projection of arms 112, 114 of headrest 110. In some examples, one end of member 123 may be securely and/or permanently connected to base portion 140. Base portion 140 may include a plurality of surfaces 142, 144, 146. In some examples, base portion 140 may include an arrangement of a first surface 142, a second surface 144, and a third surface 146. These surfaces 142, 144, 146 may be separate components or a single continuous component. In some examples, the first 142 and third 146 surfaces may comprise a u-shaped configuration. The first surface 142 may comprise a greater length than a length of the third surface 146. The second surface 144 may comprise a rectangular configuration. The second surface 144 may be configured to attach the first 142 and third surfaces 146. For example, the second surface 144 may be connected to an edge portion of the first surface 142 and an edge portion of the third surface 146 so as to expose an opening between the first 142 and third surfaces 146. Base portion 140 may be configured to receive an attachment mechanism 150 via the opening between the first 142 and third surfaces 146. In some examples, base portion 140 may be configured to both receive the end of the second member 123 in a first location of the first surface 142, and also receive an attachment mechanism 150 in a first location of the third surface 146. Base portion 140 may include material made from plastic, polymer, metal, or any combination thereof.

As shown in FIG. 1, system 100 may include an attachment mechanism 150. For example, attachment mechanism 150 may be integrated with at least a surface of base portion 140 so as to serve as a clamp, such as an industrial strength clamp. For example, attachment mechanism 150 may comprise a screw, such as the clamp screw shaft, that is rotated to enable securement of an object or one or more of its surfaces or portions such as a table, desk or a chair or the like, with base portion 140. Attachment mechanism 150 may be configured to penetrate through third surface 146 of base portion 140.

Figure 2:
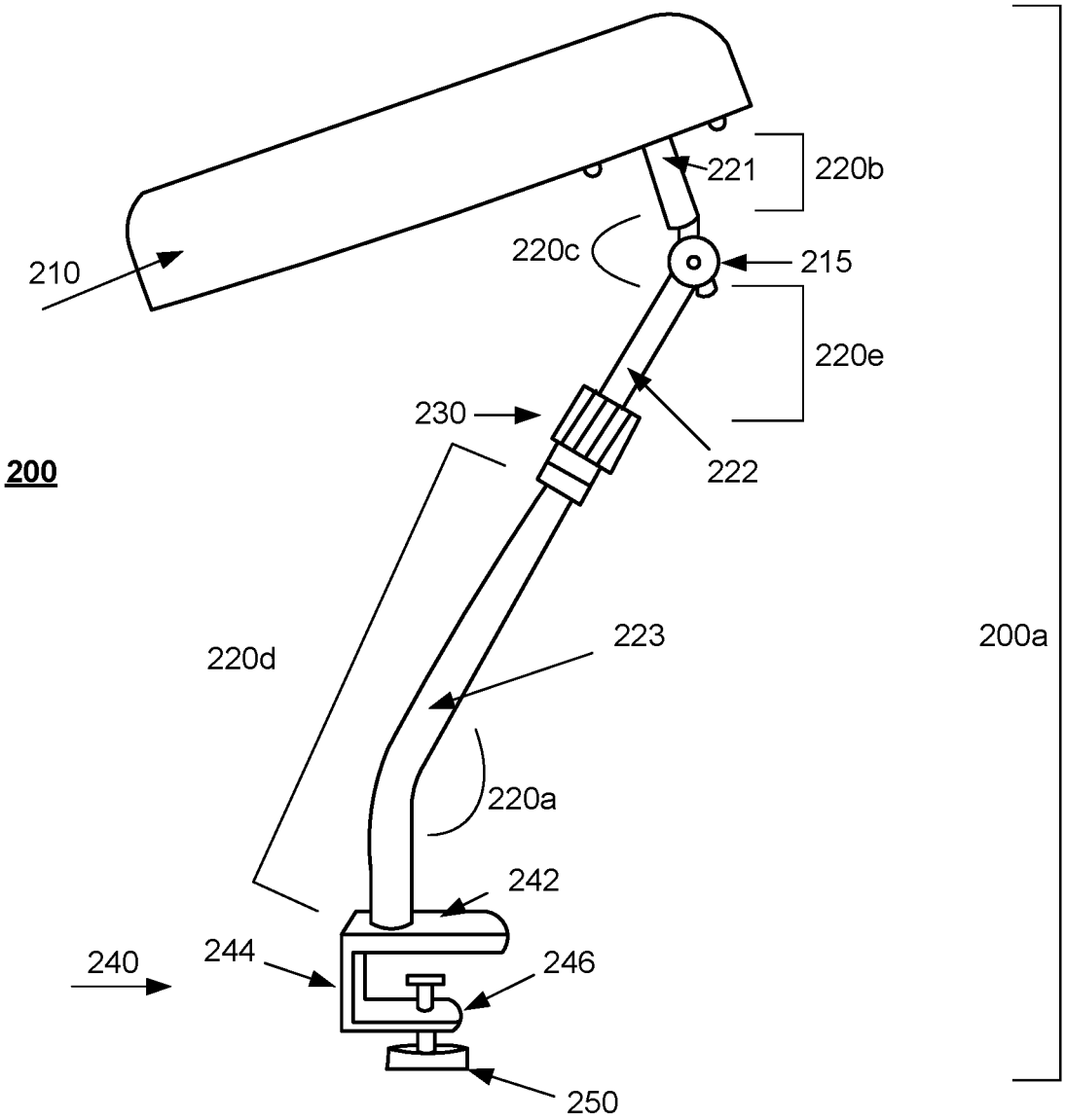
FIG. 2 depicts a schematic of a manicure headrest from a side view perspective according to an example embodiment.

FIG. 2 depicts a schematic of a manicure headrest from a side view perspective according to an example embodiment. System 200 may comprise a headrest 210, adjuster 215, a plurality of members 221, 222, 223, a fastener 230, a base portion 240, and an attachment mechanism 250. Although FIG. 2 illustrates single instances of components of system 200, system 200 may include any number of components. FIG. 2 may reference same or similar components of system 100 with respect to FIG. 1. System 200 may operate in a manner or process similar to that of system 100 with respect to FIG. 1. In some examples, system 200 may comprise a facial support system. System 200 may be configured to provide facial support vertically superior to hand positions.

As shown in FIG. 2, system 200 may include a headrest 210. Headrest 210 may comprise a u-shaped or horseshoe-shaped headrest. Other shapes may be used for the headrest. Headrest 210 may comprise a foam cushion, such as a u-shaped or horseshoe-shaped foam cushion. Headrest 210 may comprise a massage table headrest or that of a physical therapy headrest. In some examples, headrest 210 may comprise a memory foam cushion and covered in one or more of natural and synthetic coverings including but not limited to leather, natural and synthetic, or vinyl, natural and synthetic, or any combination thereof. Headrest 210 may be configured to rest at least a portion of the head of a user. Headrest 210 may include a pair of opposing curved portions or arms (not shown) that originate and project away from a center portion of headrest 210. In some examples, although headrest 210 may comprise a planar region, it is preferable that one or more portions, such as a central portion, of headrest 210 comprise a depressed or concave region. Headrest 210 may comprise an aperture.

As shown in FIG. 2, system 200 may comprise an adjuster 215. Adjuster 215 may be configured to adjust headrest 210 by a clamp. Adjuster 215 may be configured to position headrest 210 at an angle relative to the vertical axis. For example, adjuster 215 may be configured to be rotated via the clamp to adjust the angle of displacement or projection of headrest 210. Adjuster 215 may be configured to receive one end of a first member and receive one end of a second member at first and second locations of adjuster 215, respectively.

As shown in FIG. 2, system 200 may comprise members 221, 222, 223. Members 221, 222, 223 may comprise an elongated cylindrical shaped member. Members 221, 222, 223 may include material made from plastic, polymer, metal, or any combination thereof. In some examples, members, such as members 221, 222, and 223 may comprise poles, such as aluminum poles. In some examples, members 221, 222, 223 may be hollow, solid, or any combination thereof. Members 221, 222, 223 may be dimensioned so as to fit in a series-like configuration. In some examples, members 221, 222, 223 may comprise a single continuous member. In some examples, members 221, 222, 223 may comprise a first member 221, a second member 222, and a third member 223. For example, the first member 221 may comprise a length 220*b* positioned at an angle 220*c* with reference to the second member 222 by adjuster 215. The second member 222 may comprise a length 220*e*. In some examples, 220*b* may be of a dimension, such as length, less than 220*e*. 220*e* may be of a dimension, such as length, less than 220*d*. As described herein, the second 222 and third member 223 may be attached to each other by a fastener 230. The third member 223 may comprise a diameter exceeding a diameter of the second member 222. In some examples, the third member 223 may comprise a diameter same or similar with respect to a diameter of the second member 222. The third member 223 may include an angled or curved portion. For example, the third member 223 may comprise a length 220*d*. Member 223 may include an angled or curved portion 220*a*, for example, positioned between about 20° and 40°, including between 15° and 35°. Member 221 may be configured to connect to a portion of headrest 210. As described below, the portion of headrest 210 may comprise a surface positioned under headrest 210. The surface may be secured to member 221. In some examples, members 221, 222, and 223 may each comprise a length of 3 to 9 inches. In some examples, angle 220*c* may be a different angle than 220*a*.

As shown in FIG. 2, system 200 may comprise a fastener 230. In some examples, fastener 230 may include an expansion sleeve and a cap configuration. Fastener 230 may be configured to connect to one or more members. For example, fastener 230 may be configured to attach a second member 222 to a third member 223 via an expansion sleeve. One end of each of the second member 222 and third member 223 may be respectively inserted into the expansion sleeve and rotated clockwise or counterclockwise by the cap so as to lock and otherwise tighten or loosen the corresponding grip, respectively. Accordingly, fastener 230 may be configured to adjust a position of headrest 210 by rotation of fastener 230. In this manner, a height 200*a* of system 200 may be modified. Fastener 230 may include material made from plastic, polymer, metal, or any combination thereof.

As shown in FIG. 2, system 200 may include a fastening means or base portion 240. Base portion 240 may be configured to receive an end of third member 223.

In some examples, base portion 240 may comprise a clamp, such as an industrial strength clamp, or a cup, such as an industrial strength suction cup. An opening of the clamp may be 3-5 inches, including 3-4 inches, to accommodate thickness of an object, such as a table. The thickness of a clamp screw shaft, described below, may be 0.25-0.75 inches thick, including 0.5 inches, and the width of the clamp may be 1-3 inches, including 1.5-2.0 inches. The clamp may comprise material including plastic, metal, or any combination thereof.

In other examples, base portion 240 may comprise a cup, such as an industrial strength suction cup, as further discussed below with reference to FIG. 6.

Base portion 240 may comprise a jaw configuration and be configured to project away or in a direction opposite to a projection of arms 212, 214 of headrest 210. In some examples, one end of member 223 may be securely and/or permanently connected to base portion 240. Base portion 240 may include a plurality of surfaces 242, 244, 246. In some examples, base portion 240 may include an arrangement of a first surface 242, a second surface 244, and a third surface 246. These surfaces 242, 244, 246 may be separate components or a single continuous component. In some examples, the first 242 and third 246 surfaces may comprise a u-shaped configuration. The first surface 242 may comprise a greater length than a length of the third surface 246. The second surface 244 may comprise a rectangular configuration. The second surface 244 may be configured to attach the first 242 and third surfaces 246. For example, the second surface 244 may be connected to an edge portion of the first surface 242 and an edge portion of the third surface 246 so as to expose an opening between the first 242 and third surfaces 246. Base portion 240 may be configured to receive an attachment mechanism 250 via the opening between the first 242 and third surfaces 246. In some examples, base portion 240 may be configured to both receive the end of the third member 223 in a first location of the first surface 242, and also receive an attachment mechanism 250 in a first location of the third surface 246. Base portion 140 may include material made from plastic, polymer, metal, or any combination thereof.

As shown in FIG. 2, system 200 may include an attachment mechanism 250. Attachment mechanism 250 may be integrated with at least a surface of base portion 240 so as to serve as a clamp, such as an industrial strength clamp. For example, attachment mechanism 250 may comprise a screw, such as the clamp screw shaft, that is rotated to enable securement of an object or one or more of its surfaces or portions such as a table, desk or a chair or the like, with base portion 240, such as a table, desk or a chair or the like. Attachment mechanism 250 may be configured to penetrate through the third surface 246 of base portion 240. In some examples, attachment mechanism 250 may comprise a non-permanent fastener clamp.

Figure 3:
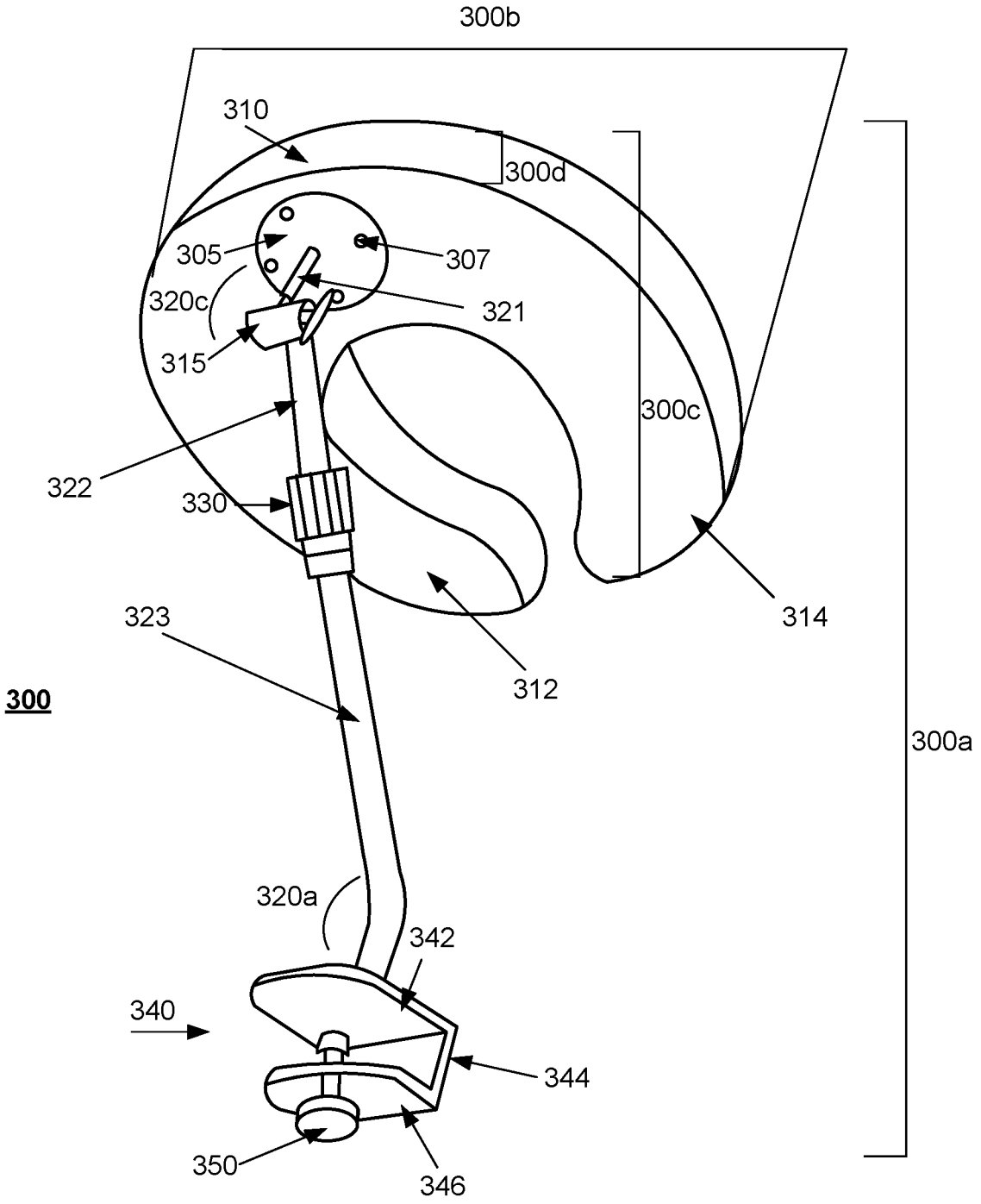
FIG. 3 depicts a schematic of a manicure headrest from a rear view perspective according to an example embodiment.

FIG. 3 depicts a schematic of a manicure headrest from a rear view perspective according to an example embodiment. System 300 may comprise a plate 305, headrest 310, adjuster 315, a plurality of members 321, 322, 323, a fastener 330, a base portion 340, and an attachment mechanism 350. Although FIG. 3 illustrates single instances of components of system 300, system 300 may include any number of components. FIG. 3 may reference same or similar components of system 200 with respect to FIG. 2. System 300 may operate in a manner or process similar to that of system 200 with respect to FIG. 2. In some examples, system 300 may comprise a facial support system. System 300 may be configured to provide facial support vertically superior to hand positions.

As shown in FIG. 3, system 300 may include a plate 305. Plate 305 may be configured to connect at least a portion of headrest 310 to adjuster 315 via member 321. For example, plate 305 may be secured to a surface of headrest 310 via a plurality of screws 307. Plate 305 may comprise a circular shaped plate disposed at the center of headrest 310. Plate 305 may be configured to receive an end of member 321.

As shown in FIG. 3, system 300 may include a headrest 310. Headrest 310 may comprise a u-shaped or horseshoe-shaped headrest. Other shapes may be used for the headrest. Headrest 310 may comprise a foam cushion, such as a u-shaped or horseshoe-shaped foam cushion. Headrest 310 may comprise a massage table headrest or that of a physical therapy headrest. In some examples, headrest 310 may comprise a memory foam cushion and covered in one or more of natural and synthetic coverings including but not limited to leather, natural and synthetic, or vinyl, natural and synthetic, or any combination thereof. Headrest 310 may be configured to rest at least a portion of the head of a user. Headrest 310 may include a pair of opposing curved portions 312, 314 or arms that originate and project away from a center portion of headrest 310. For example, headrest 310 may include a length 300*b*, width 300*c*, and thickness 300*d*. In some examples, headrest 310 may comprise a length 300*b* of eight to ten inches, including 9.5 inches, width 300*c* of ten to twelve inches, including eleven inches, and a thickness 300*d* of two to five inches, including three to four inches or two to 2.5 inches, and configured in a u-shape or horseshoe-shape to form headrest 310. In some examples, although headrest 310 may comprise a planar region, it is preferable that one or more portions, such as a central portion, of headrest 310 comprise a depressed or concave region. Headrest 310 may comprise an aperture.

As shown in FIG. 3, system 300 may comprise an adjuster 315. For example, adjuster 315 may be configured to adjust headrest 310 by a clamp. Adjuster 315 may be configured to position headrest 310 at an angle relative to the vertical axis. For example, adjuster 315 may be configured to be rotated via the clamp to adjust the angle of displacement or projection of headrest 310. Adjuster 315 may be configured to receive one end of a first member and 321 receive one end of a second member 322 at first and second locations of adjuster 315, respectively.

As shown in FIG. 3, system 300 may comprise members 321, 322, 323. Members 321, 322, 323 may comprise an elongated cylindrical shaped member. Members 321, 322, 323 may include material made from plastic, polymer, metal, or any combination thereof. In some examples, members, such as members 321, 322, and 323 may comprise poles, such as aluminum poles. In some examples, members 321, 322, 323 may be hollow, solid, or any combination thereof. Members 321, 322, 323 may be dimensioned so as to fit in a series-like configuration. In some examples, members 321, 322, 323 may comprise a single continuous member. In some examples, members 321, 322, 323 may comprise a first member 321, a second member 322, and a third member 323. As described herein, the second 322 and third member 323 may be attached to each other by a fastener 330. The second member 322 may comprise a diameter exceeding a diameter of the first member 321. The third member 323 may comprise a diameter exceeding a diameter of the second member 322. In some examples, the third member 323 may comprise a diameter same or similar with respect to a diameter of the second member 322. The third member 323 may include an angled or curved portion. For example, member 323 may include an angled or curved portion 320*a*, for example, positioned between about 20° and 40°, including between 15° and 35°. Member 321 may be configured to connect to a portion of headrest 310. For example, member 321 may be positioned at an angle 320*c* with reference to member 322 by adjuster 315. In some examples, angle 320*c* may be a different angle than angle 320*a*. As described below, the portion of headrest 310 may comprise a surface positioned under headrest 310. The surface may be secured to member 321. In some examples, members 321, 322, and 323 may each comprise a length of 3 to 9 inches.

As shown in FIG. 3, system 300 may comprise a fastener 330. In some examples, fastener 330 may include an expansion sleeve and a cap configuration. Fastener 330 may be configured to connect to one or more members. For example, fastener 330 may be configured to attach a second member 322 to a third member 323 via an expansion sleeve. One end of each of the second member 322 and third member 323 may be inserted into the expansion sleeve and rotated clockwise or counterclockwise by the cap so as to lock and otherwise tighten or loosen the corresponding grip, respectively. Accordingly, fastener 330 may be configured to adjust a position of headrest 310 by rotation of fastener 330. In this manner, a height 300*a* of system 300 may be modified. Fastener 330 may include material made from plastic, polymer, metal, or any combination thereof.

As shown in FIG. 3, system 300 may include a fastening means or base portion 340. Base portion 340 may be configured to receive the end of the third member 323.

In some examples, base portion 340 may comprise a clamp, such as an industrial strength clamp, or a cup, such as an industrial strength suction cup. An opening of the clamp may be 3-5 inches, including 3-4 inches, to accommodate thickness of an object, such as a table. The thickness of a clamp screw shaft, described below, may be 0.25-0.75 inches thick, including 0.5 inches, and the width of the clamp may be 1-3 inches, including 1.5-2.0 inches. The clamp may comprise material including plastic, metal, or any combination thereof.

In other examples, base portion 340 may comprise a cup, such as an industrial strength suction cup, as further discussed below with reference to FIG. 6.

Base portion 340 may comprise a jaw configuration and be configured to project away or in a direction opposite to a projection of arms 312, 314 of headrest 310. In some examples, one end of member 323 may be securely and/or permanently connected to base portion 340. Base portion 340 may include a plurality of surfaces 342, 344, 346. In some examples, base portion 340 may include an arrangement of a first surface 342, a second surface 344, and a third surface 346. These surfaces 342, 344, 346 may be separate components or a single continuous component. In some examples, the first 342 and third 346 surfaces may comprise a u-shaped configuration. The first surface 342 may comprise a greater length than a length of the third surface 346. The second surface 344 may comprise a rectangular configuration. The second surface 344 may be configured to attach the first 342 and third 346 surfaces. For example, the second surface 344 may be connected to an edge portion of the first surface 342 and an edge portion of the third surface 346 so as to expose an opening between the first 342 and third surfaces 346. Base portion 340 may be configured to receive an attachment mechanism 350 via the opening between the first 342 and third 346 surfaces. In some examples, base portion 340 may be configured to both receive the end of the third member 323 in a first location of the first surface 342, and also receive an attachment mechanism 350 in a first location of the third surface 346. Base portion 340 may include material made from plastic, polymer, metal, or any combination thereof.

As shown in FIG. 3, system 300 may include an attachment mechanism 350. Attachment mechanism 350 may be integrated with at least a surface of base portion 340 so as to serve as a clamp, such as an industrial strength clamp. For example, attachment mechanism 350 may comprise a screw, such as the clamp screw shaft, that is rotated to enable securement of an object or one or more of its surfaces or portions such as a table, desk or a chair or the like, with base portion 340. Attachment mechanism 350 may be configured to penetrate through the third surface 346 of base portion 340 via an opening of the third surface.

Figure 4:
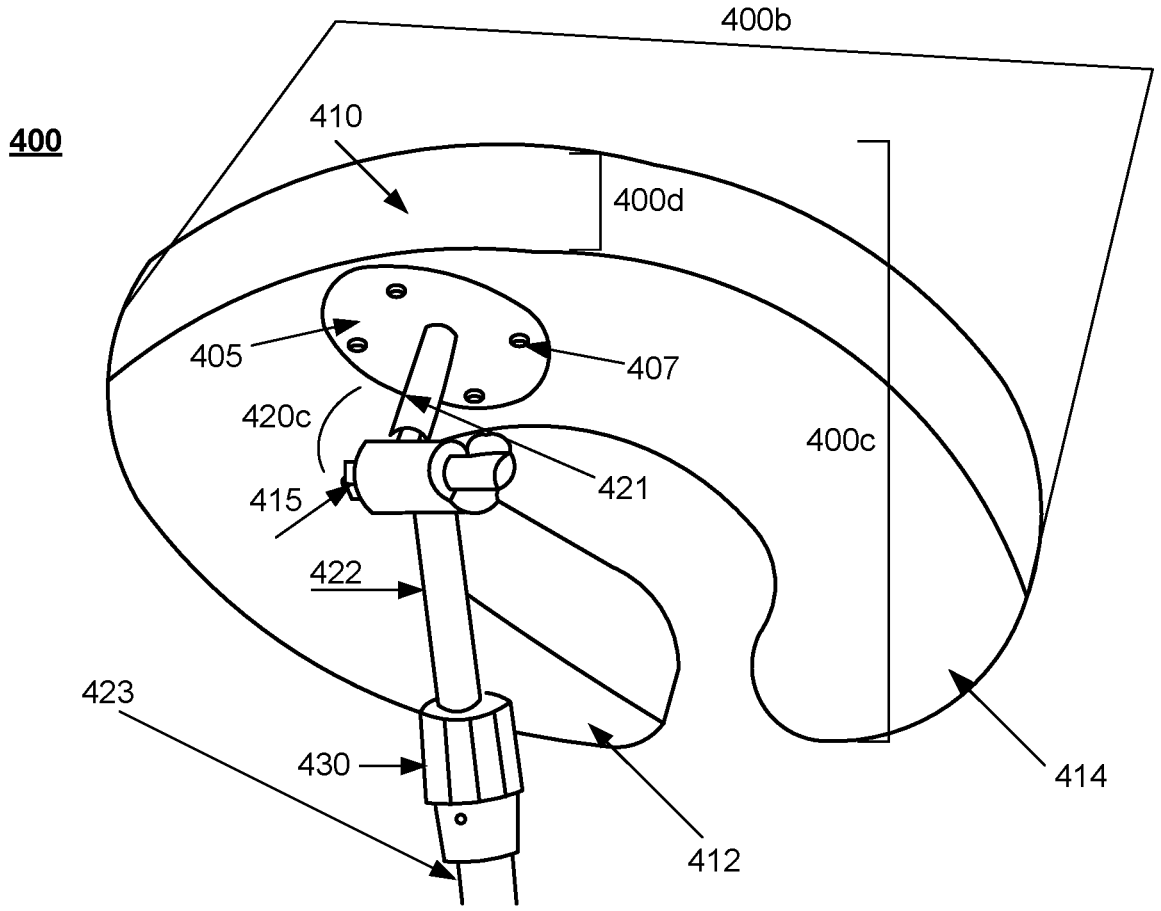
FIG. 4 depicts an enlarged view of a schematic of a manicure headrest from a rear view perspective according to an example embodiment.

FIG. 4 depicts an enlarged view of a schematic of a manicure headrest from a rear view perspective according to an example embodiment. System 400 may comprise a plate 405, headrest 410, adjuster 415, a plurality of members 421, 422, 423, and a fastener 430. Although FIG. 4 illustrates single instances of components of system 400, system 400 may include any number of components. FIG. 4 may reference same or similar components of system 300 with respect to FIG. 3. System 400 may operate in a manner or process similar to that of system 300 with respect to FIG. 3. In some examples, system 400 may comprise a facial support system. System 400 may be configured to provide facial support vertically superior to hand positions.

As shown in FIG. 4, system 400 may include a plate 405. Plate 405 may be configured to connect at least a portion of headrest 410 to adjuster 415 via member 421. For example, plate 405 may be secured to a surface of headrest 410 via a plurality of screws 407. Plate 405 may comprise a circular shaped plate disposed at the center of headrest 410. Plate 405 may be configured to receive an end of member 421.

As shown in FIG. 4, system 400 may include a headrest 410. Headrest 410 may comprise a u-shaped or horseshoe-shaped headrest. Other shapes may be used for the headrest. Headrest 410 may comprise a foam cushion, such as a u-shaped or horseshoe-shaped foam cushion. Headrest 410 may comprise a massage table headrest or that of a physical therapy headrest. In some examples, headrest 410 may comprise a memory foam cushion and covered in one or more of natural and synthetic coverings including but not limited to leather, natural and synthetic, or vinyl, natural and synthetic, or any combination thereof. Headrest 410 may be configured to rest at least a portion of the head of a user. Headrest 410 may include a pair of opposing curved portions 412, 414 or arms that originate and project away from a center portion of headrest 410. For example, headrest 410 may include a length 400*b*, width 400*c*, and thickness 400*d*. In some examples, headrest 410 may comprise a length 400*b* of eight to ten inches, including 9.5 inches, width 400*c* of ten to twelve inches, including eleven inches, and a thickness 400*d* of two to five inches, including three to four inches or two to 2.5 inches, and configured in a u-shape or horseshoe-shape to form headrest 410. In some examples, although headrest 410 may comprise a planar region, it is preferable that one or more portions, such as a central portion, of headrest 410 comprise a depressed or concave region. Headrest 410 may comprise an aperture.

As shown in FIG. 4, system 400 may comprise an adjuster 415. For example, adjuster 415 may be configured to adjust headrest 410 by a clamp. Adjuster 415 may be configured to position headrest 410 at an angle relative to the vertical axis. For example, adjuster 415 may be configured to be rotated via the clamp to adjust an angle 420*c* of displacement or projection from headrest 410. Adjuster 415 may be configured to receive one end of a first member and receive one end of a second member at first and second locations of adjuster 415, respectively.

As shown in FIG. 4, system 400 may comprise members 421, 422, 423. Members 421, 422, 423 may comprise an elongated cylindrical shaped member. Members 421, 422, 423 may include material made from plastic, polymer, metal, or any combination thereof. In some examples, members, such as members 421, 422, and 423 may comprise poles, such as aluminum poles. In some examples, members 421, 422, 423 may be hollow, solid, or any combination thereof. Members 421, 422, 423 may be dimensioned so as to fit in a series-like configuration. In some examples, members 421, 422, 423 may comprise a single continuous member. In some examples, members may comprise a first member 421, a second member 422, and a third member 423. As described herein, the second 422 and third member 423 may be attached to each other by a fastener 430. The second member 422 may comprise a diameter exceeding a diameter of the first member 421. The third member 423 may comprise a diameter exceeding a diameter of the second member 422. In some examples, the third member 423 may comprise a diameter same or similar with respect to a diameter of the second member 422. The third member 423 may include an angled or curved portion. Member 421 may be configured to connect to a portion of headrest 410. As described below, the portion of headrest 410 may comprise a surface positioned under headrest 410. The surface may be secured to member 421. In some examples, members 421, 422, and 423 may each comprise a length of 3 to 9 inches.

As shown in FIG. 4, system 400 may comprise a fastener 430. In some examples, fastener 430 may include an expansion sleeve and a cap configuration. Fastener 430 may be configured to connect to one or more members. For example, fastener 430 may be configured to attach a second member 422 to a third member 423 via an expansion sleeve. One end of each of the second member 422 and third member 423 may be inserted into the expansion sleeve and rotated clockwise or counterclockwise by the cap so as to lock and otherwise tighten or loosen the corresponding grip, respectively. Accordingly, fastener 430 may be configured to adjust a position of headrest 410 by rotation of fastener 430. In this manner, a height (not shown) of system 400 may be modified. Fastener 430 may include material made from plastic, polymer, metal, or any combination thereof.

It is understood that FIG. 4 may also include a fastening means or base portion (not shown) and attachment mechanism (not shown), similar to that of FIG. 3.

Figure 5:
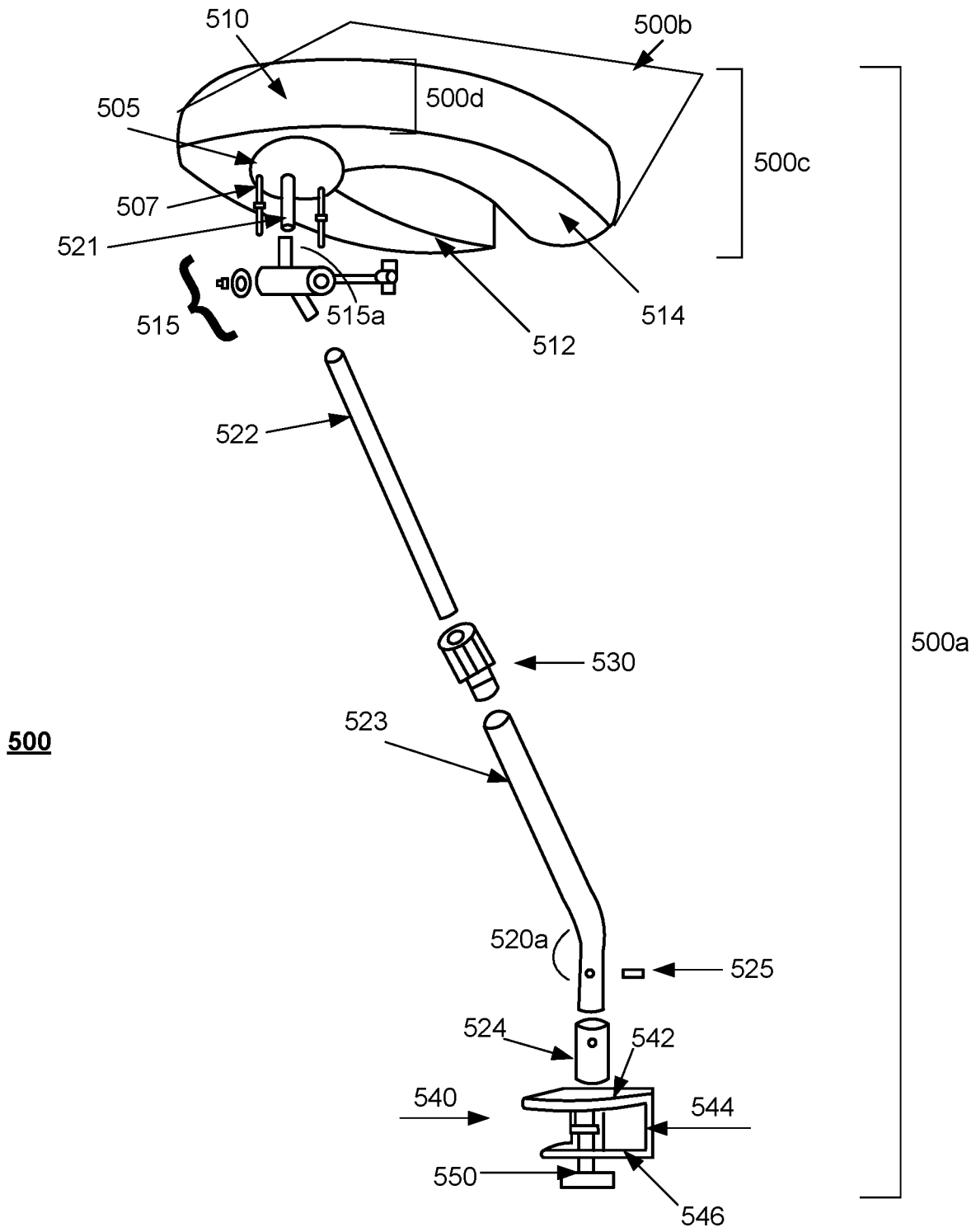
FIG. 5 depicts a schematic of a plurality of components of a manicure headrest according to an example embodiment.

FIG. 5 depicts a schematic of a plurality of components of a manicure headrest according to an example embodiment. System 500 may comprise a plate 505, headrest 510, adjuster 515, a plurality of members 521, 522, 523, 524, a fastener 530, a fastening means or base portion 540, and an attachment mechanism 550. Although FIG. 5 illustrates single instances of components of system 500, system 500 may include any number of components. FIG. 5 may reference same or similar components of system 300 with respect to FIG. 3. System 500 may operate in a manner or process similar to that of system 300 with respect to FIG. 3. As depicted in FIG. 5, components of system 500 may be detachable. FIG. 5 may comprise a height 500*a* representing the height of system 500. In some examples, system 500 may comprise a facial support system. System 500 may be configured to provide facial support vertically superior to hand positions.

As shown in FIG. 5, system 300 may include a plate 505. Plate 505 may be configured to connect at least a portion of headrest 510 to adjuster 515 via member 521. For example, plate 505 may be secured to a surface of headrest 510 via a plurality of screws 507. Plate 505 may comprise a circular shaped plate disposed at the center of headrest 510. Plate 505 may be configured to receive an end of member 521.

As shown in FIG. 5, system 500 may include a headrest 510. Headrest 510 may comprise a u-shaped or horseshoe-shaped headrest. Other shapes may be used for the headrest. Headrest 510 may comprise a foam cushion, such as a u-shaped or horseshoe-shaped foam cushion. Headrest 510 may comprise a massage table headrest or that of a physical therapy headrest. In some examples, headrest 510 may comprise a memory foam cushion and covered in one or more of natural and synthetic coverings including but not limited to leather, natural and synthetic, or vinyl, natural and synthetic, or any combination thereof. Headrest 510 may be configured to rest at least a portion of the head of a user. Headrest 510 may include a pair of opposing curved portions 512, 514 or arms that originate and project away from a center portion of headrest 510. For example, headrest 510 may include a length 500*b*, width 500*c*, and thickness 500*d*. In some examples, headrest 510 may comprise a length 500*b* of eight to ten inches, including 9.5 inches, width 500*c* of ten to twelve inches, including eleven inches, and a thickness 500*d* of two to five inches, including three to four inches or two to 2.5 inches, and configured in a u-shape or horseshoe-shape to form headrest 510. For example, length 500*b* may be 25 cm, width 500*c* may be 30 cm, and thickness 500*d* may be 6 cm. In some examples, although headrest 510 may comprise a planar region, it is preferable that one or more portions, such as a central portion, of headrest 510 comprise a depressed or concave region. Headrest 510 may comprise an aperture.

As shown in FIG. 5, system 500 may comprise an adjuster 515. For example, adjuster 515 may be configured to adjust headrest 510 by a clamp, washer and screw arrangement. Adjuster 515 may be configured to position headrest 510 at an angle relative to the vertical axis. For example, adjuster 515 may be configured to be rotated via the clamp to adjust the angle of displacement or projection of headrest 510 and tightened or loosened by a washer and screw. Adjuster 515 may be configured to receive one end of a first member and receive one end of a second member at first and second locations of adjuster 515, respectively. In some examples, adjuster 515 may include one or more receiving portions configured to connect to members 521 and 522. For example, one of the receiving portions of adjuster 515 may be disposed at angle on a surface of adjuster 515, such as an exterior portion, that is configured to connect to members 521 and 522. In some examples, one of the receiving portions of adjuster 515 may be disposed at an angle 515*a* between about 20° and 160°. In some examples, angle 515*a* may be a different angle than angle 520*a*.

As shown in FIG. 5, system 500 may comprise members 521, 522, 523, 524. Members 521, 522, 523, 524 may comprise an elongated cylindrical shaped member. Members 521, 522, 523, 524 may include material made from plastic, polymer, metal, or any combination thereof. In some examples, members, such as members 521, 522, 523, and 524 may comprise poles, such as aluminum poles. In some examples, members 521, 522, 523, 524 may be hollow, solid, or any combination thereof. Members 521, 522, 523, 524 may be dimensioned so as to fit in a series-like configuration. In some examples, members 521, 522, 523, 524 may comprise a single continuous member. In some examples, members may comprise a first member 521, a second member 522, a third member 523, and a fourth member 524. As described herein, the second 522 and third member 523 may be attached to each other by a fastener 530. The second member 522 may comprise a diameter exceeding a diameter of the first member 521. The third member 523 may comprise a diameter exceeding a diameter of the second member 522. The fourth member 524 may comprise a diameter exceeding a diameter of the third member 523. In some examples, the fourth member 524 may comprise a diameter same or similar with respect to a diameter of the third member 523. The third member 523 may include an angled or curved portion. Member 523 may include an angled or curved portion 520*a*, for example, positioned between about 20° and 40°, including between 15° and 35°. The fourth member 524 may be configured to receive the third member 523 via one or more pins 525. For example, the third 523 and fourth 524 members may each comprise an aperture at predetermined locations so as to connect to each other via one or more pins 525. Member 521 may be configured to connect to a portion of headrest 510. As described below, the portion of headrest 510 may comprise a surface positioned under headrest 510. The surface may be secured to member 521. In some examples, members 521, 522, 523, 524 may each comprise a length of 3 to 9 inches. For example, member 521 may comprise a length of 20 cm, member 522 may comprise a length of 20 cm, member 523 may comprise a length of 8 cm, and member 524 may comprise a length of 12 cm.

As shown in FIG. 5, system 500 may comprise a fastener 530. In some examples, fastener 530 may include an expansion sleeve and a cap configuration. Fastener 530 may be configured to connect to one or more members. For example, fastener 530 may be configured to attach a second member 522 to a third member 523 via an expansion sleeve. One end of each of the second member 522 and third member 523 may be inserted into the expansion sleeve and rotated clockwise or counterclockwise by the cap so as to lock and otherwise tighten or loosen the corresponding grip, respectively. Accordingly, fastener 530 may be configured to adjust a position of headrest 510 by rotation of fastener 530. In this manner, a height 500*a* of system 500 may be modified. Fastener 530 may include material made from plastic, polymer, metal, or any combination thereof.

As shown in FIG. 5, system 500 may include a fastening means or base portion 540. Base portion 140 may be configured to receive an end of member 524. Base portion 540 may be configured to receive the end of a member, such as the fourth member 524.

In some examples, base portion 540 may comprise a clamp, such as an industrial strength clamp, or a cup, such as an industrial strength suction cup. An opening of the clamp may be 3-5 inches, including 3-4 inches, to accommodate thickness of an object, such as a table. The thickness of a clamp screw shaft, described below, may be 0.25-0.75 inches thick, including 0.5 inches, and the width of the clamp may be 1-3 inches, including 1.5-2.0 inches. The clamp may comprise material including plastic, metal, or any combination thereof.

In other examples, base portion 540 may comprise a cup, such as an industrial strength suction cup, as further discussed below with reference to FIG. 6.

Base portion 540 may comprise a jaw configuration and be configured to project away or in a direction opposite to a projection of arms 512, 514 of headrest 510. In some examples, one end of member 524 may be securely and/or permanently connected to base portion 540. Base portion 540 may include a plurality of surfaces 542, 544, 546. In some examples, base portion 540 may include an arrangement of a first surface 542, a second surface 544, and a third surface 546. These surfaces may be separate components or a single continuous component. In some examples, the first 542 and third 546 surfaces may comprise a u-shaped configuration. The first surface 542 may comprise a greater length than a length of the third surface 546. The second surface 544 may comprise a rectangular configuration. The second surface 544 may be configured to attach the first 542 and third 546 surfaces. For example, the second surface 544 may be connected to an edge portion of the first surface 542 and an edge portion of the third surface 546 so as to expose an opening between the first 542 and third 546 surfaces. Base portion 540 may be configured to receive an attachment mechanism 550 via the opening between the first 542 and third 546 surfaces. In some examples, base portion 540 may be configured to both receive the end of the fourth member 524 in a first location of the first surface 542, and also receive an attachment mechanism 550 in a first location of the third surface 546. Base portion 540 may include material made from plastic, polymer, metal, or any combination thereof.

As shown in FIG. 5, system 500 may include an attachment mechanism 550. Attachment mechanism 550 may be integrated with at least a surface of base portion 540 so as to serve as a clamp, such as an industrial strength clamp. For example, attachment mechanism 550 may comprise a screw that is rotated to enable securement of an object or one or more of its surfaces or portions such as a table, desk or a chair or the like, with base portion 540. Attachment mechanism 550 may be configured to penetrate through the third surface 546 of base portion 540 via an opening of the third surface 546.

Figure 6:
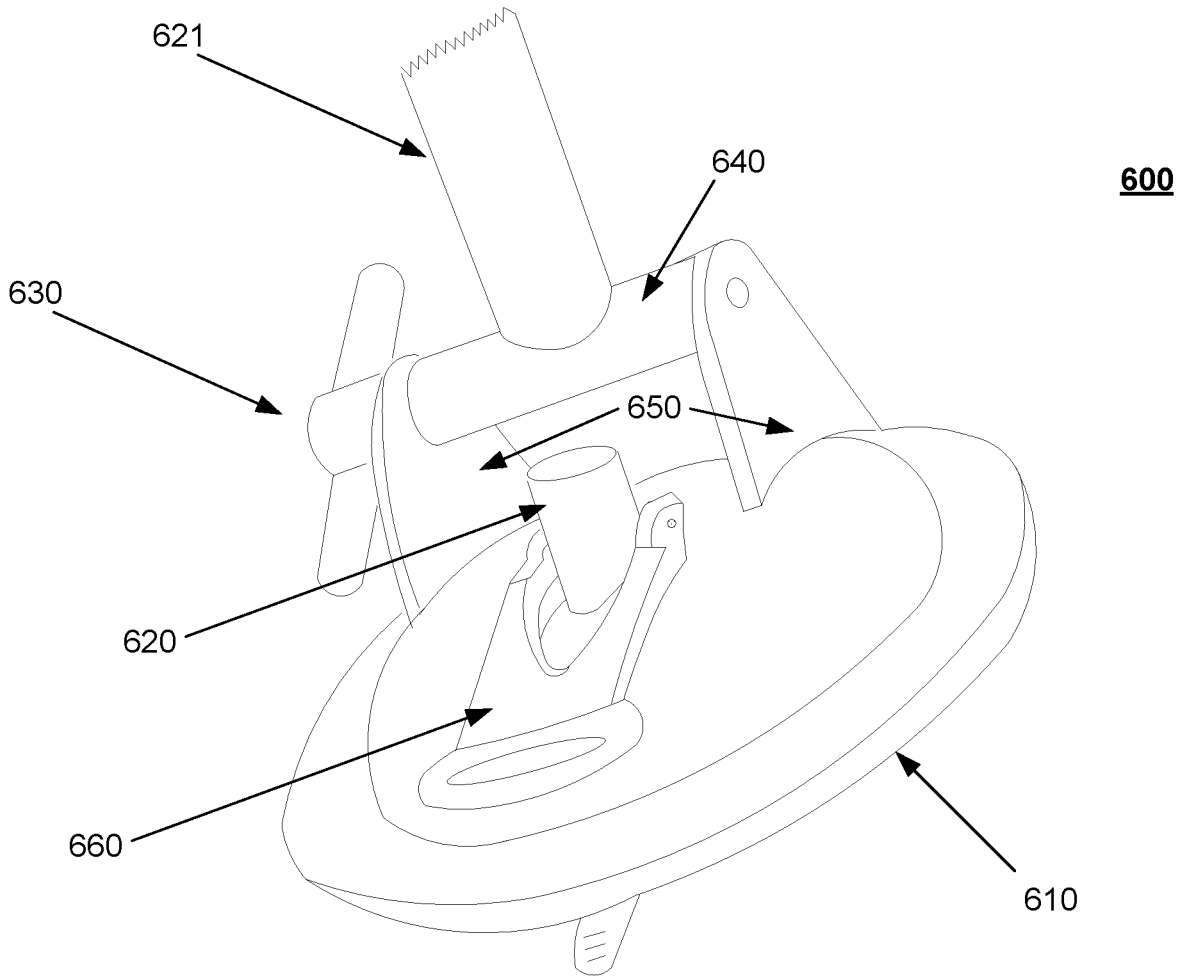
FIG. 6 depicts a schematic of a suction cup according to an example embodiment.

As shown in FIG. 6, fastening means may comprise a cup 600, such as an industrial strength suction cup. System (not shown) of FIG. 6 may reference any system and components of FIGS. 1-5, as previously discussed above. Although FIG. 6 illustrates single instances of components of system, the system may include any number of components. In some examples, the cup 600 may comprise a diameter of 2-5 inches, including 3-4 inches, and a height of 1-3 inches, including 1-2 inches. The cup 600 may comprise material including rubber, plastic, or any combination thereof. As illustrated in FIG. 6, cup 600 may comprise one or more layers 610 coupled to one or more members 620 and 621, lock 630, a structure 640, one or more connections 650, and lift portion 660. One or more members 620 may be connected to one or more additional members, including but not limited to member 621. In some examples, one or more layers 610 may comprise a shaped portion, such as an elliptical or rectangular or circular or any other shape or any combination thereof, that is configured to be locked by lock 630 so as to prevent disengagement with one or more surfaces of table, desk, or chair (not shown), respectively, since minimum or no air is allowed. Lock 630 may be configured to rotate in a clockwise and/or counterclockwise direction, relative to a vertical axis, so as to tighten and/or loosen a structure 640 coupled to one or more members 621 and thereby control exerted pressure associated with one or more layers 610 of cup 600. The cup 600 may be pressured onto the one or more surfaces of table, desk, or chair (not shown), respectively. Thus, a vacuum may be created which then releases air when cup 600 is pushed out, for example via a lift portion 660, from the one or more surfaces of table, desk, or chair, respectively by lock 630. One or more members 620 may be coupled to a structure 640 also configured to connect to lock 630. As a consequence, structure 640 may allow varying angles and/or displacements of one or more members 620 with reference to an axis of structure 640. As depicted in FIG. 6, structure 640 may be coupled, for example, via one or more connections 650, such as hinged connections, to one or more layers 610.

In the preceding specification, various embodiments have been described with references to the accompanying drawings. It will, however, be evident that various modifications and changes may be made thereto, and additional embodiments may be implemented, without departing from the broader scope of the invention as set forth in the claims that follow. The specification and drawings are accordingly to be regarded as an illustrative rather than restrictive sense.

We claim:

1. A manicure system comprising: a head rest mechanically coupled to a plurality of members at one end of the plurality of members that is mechanically coupled to a fastening means at another end, wherein a first member is connected to the head rest at one end and second member at the other end, wherein the second member is connected to the first member at one end and a third member at the other end, wherein the third member is connected to the second member at one end and a fourth member at the other end, wherein the fourth member is connected to the third member at one end and the fastening means at the other end, wherein the fourth member is permanently connected to the fastening means, and wherein the fastening means is disposed in a direction opposite to and below the head rest, and wherein the second and third members are connected by means of an adapter that is configured to allow the second member to slide in and out of the third member.

2. The manicure system of claim 1, wherein the head rest is horseshoe-shaped.

3. The manicure system of claim 1, wherein a lateral width of the head rest is about 10-12 inches.

4. The manicure system of claim 1, wherein a length of the head rest is about 8-10 inches.

5. The manicure system of claim 1, wherein a thickness of the head rest is about 2-5 inches.

6. The manicure system of claim 1, wherein the head rest comprises natural or synthetic vinyl or leather material, or any combination thereof.

7. The manicure system of claim 1, wherein the first member is configured to position the head rest at a predetermined angle.

8. The manicure system of claim 7, wherein the predetermined angle is between about 20° and 40°.

9. The manicure system of claim 1, wherein the first member, second member, or both is about 20 cm in length.

10. The manicure system of claim 1, wherein at least one of the members comprises an angled portion having an angle between about 20° and 40°.

11. The manicure system of claim 1, wherein at least one of the members is configured to adjust a height of the system.

12. The manicure system of claim 1, wherein the first and second members are connected by means of an adapter.

13. The manicure system of claim 12, wherein the first and second members are connected by the adapter at an angle between about 20° and 160°.

14. The manicure system of claim 1, wherein the third member is about 8 cm in length.

15. The manicure system of claim 1, wherein the fourth member is about 12 cm in length.

16. The manicure system of claim 1, wherein the third and fourth members are connected by a fastener.

17. The manicure system of claim 1, wherein the fastening means is configured to secure the system to one or more portions of a table, desk, or chair.

18. The manicure system of claim 1, further comprising a fifth component configured to connect at least a portion of the head rest to the first member via a plurality of screws.

19. The manicure system of claim 1, wherein at least one of the members includes a curved portion.

20. The manicure system of claim 1, wherein the head rest comprises one or more concave portions.

21. The manicure system of claim 1, wherein the fastening means comprises a clamp.

22. The manicure system of claim 21, wherein the clamp comprises a first surface configured to connect to the fourth member.

23. The manicure system of claim 22, wherein the clamp comprises a second surface that is positioned in a direction parallel to the first surface.

24. The manicure system of claim 23, wherein the second surface is configured to receive one or more screws.

25. The manicure system of claim 21, wherein the clamp comprises a screw-type adjustable clamp.

26. The manicure system of claim 21, wherein the clamp comprises a width of about 1-3 inches.

27. The manicure system of claim 1, wherein the fastening means comprises a suction cup.

28. The manicure system of claim 27, wherein the suction cup comprises a diameter of about 2-5 inches.

29. The manicure system of claim 1, wherein the head rest is configured to receive a front facial portion.

30. The manicure system of claim 1, wherein each of the plurality of members comprise a cylindrical shape.

31. A method of manufacturing a manicure system, comprising:

connecting a head rest to a first member of a plurality of members via a first component;

connecting the first member to a second member via a second component;

connecting the second member to a third component by means of an adapter that is configured to allow the second member to slide in and out of the third member; and connecting the third component to a fourth component, wherein a fastening means is connected to the fourth component and is disposed in a direction opposite to and below the head rest.

32. The method of claim 31, wherein the fourth component is permanently coupled to the fastening means.

33. A manicure system comprising: a head rest mechanically coupled to a plurality of members at one end of the plurality of members that is mechanically coupled to a fastening means at another end, wherein a first member is connected to the head rest at one end and second member at the other end, wherein the second member is connected to the first member at one end and a third member at the other end, wherein the third member is connected to the second member at one end and a fourth member at the other end, wherein the fourth member is connected to the third member at one end and the fastening means at the other end, wherein the fourth member is permanently connected to the fastening means, and wherein the fastening means is disposed in a direction opposite to and below the head rest, and wherein each of the plurality of members comprise a cylindrical shape.

* * * * *